United States Patent [19]

Posso

[11] Patent Number: 4,863,222

[45] Date of Patent: Sep. 5, 1989

[54] STORAGE ARRANGEMENT CONSTITUTED BY A STACK OF BOXES

[75] Inventor: Patrick P. P. Posso, Lausanne, Switzerland

[73] Assignee: Gefitec S.A., Switzerland

[21] Appl. No.: 333,711

[22] Filed: Mar. 31, 1989

Related U.S. Application Data

[63] Continuation of Ser. No. 88,269, Aug. 24, 1988, abandoned, which is a continuation of Ser. No. 751,089, Jul. 2, 1985, abandoned.

[30] Foreign Application Priority Data

Jul. 10, 1984 [FR] France ..... 84 10933

[51] Int. Cl.[4] ..... A47B 87/00

[52] U.S. Cl. ..... 312/107; 206/504

[58] Field of Search ..... 312/107, 108, 111; 206/503, 504, 509; 220/4 C, 4 D, 23.83, 23.86

[56] References Cited

U.S. PATENT DOCUMENTS 2,128,854 8/1938 Sagendorph et al. ..... 312/107

3,743,372 7/1973 Raggerone ..... 312/108

FOREIGN PATENT DOCUMENTS 329254 11/1920 Fed. Rep. of Germany ..... 312/107

963494 7/1964 United Kingdom ..... 206/504

OTHER PUBLICATIONS

IBM Tech. Disc. Bulletin, 10/1977, 220/23.83, vol. 20, No. 5, pp. 1683-1684.

*Primary Examiner*—Kenneth J. Dorner

*Assistant Examiner*—Gerald A. Anderson

*Attorney, Agent, or Firm*—Kane, Dalsimer, Sullivan, Kurucz, Levy, Eisele and Richard

[57] ABSTRACT

Arrangement constituted by a stack of boxes intended to contain drawers, in particular for the storage of audio and video recording tapes. The boxes have different dimensions. The widths and heights of the boxes are dimensioned to adapt to the contents and to allow a large number of combinations. On their upper side, the boxes comprise profiled ribs on which are fitted grooves of matching profile provided on a lower side of the boxes.

10 Claims, 7 Drawing Sheets

STORAGE ARRANGEMENT CONSTITUTED BY A STACK OF BOXES

This is a continuation of application Ser. No. 07/088,269, filed on Aug. 24, 1988, now abandoned, which was a continuation of U.S. application Ser. No. 751,089 filed July 2, 1985, now abandoned.

The present invention relates to a storage arrangement for compact storing audio and visual cassettes constituted by a stack of horizontal prismatic boxes intended to contain drawers.

In a first known arrangement, the boxes, all of the same dimensions, may be tilted one on the other and one beside the other. In view of the fact that there is only one dimension of box, an arrangement of this type is ill suited for the storage of recording tapes, in particular audio and video tapes, of different dimensions such as they are encountered in practice. In this case, the dimensions of the boxes can only be a compromise. If for example, the receptacle makes it possible to store video cassettes easily, the space available for storing mini-cassettes (audio cassettes) is much too great.

In another storage arrangement (German MU No. 80 22 624), all the boxes are also of the same width, but they may contain one or more drawers juxtaposed so that the possible widths are limited to two, namely the full width or half this same width. The boxes are provided in order to be stacked with a vertical alignment. The arrangements and the number of possible combinations are limited and the maximum height of the boxes is insufficient in order to be able to store vertically compact discs read by laser.

In addition, the limitation to a single width of module involves unacceptable solutions as regards the arrangement of the contents. For example, mini audio cassettes in their box must be placed vertically in each of the two drawers contained in one module so that the labels of the cassette boxes are located on their side and the user must bend alternately to the right and to the left in order to read the labels located on the edge of the boxes of the respective right-hand and left-hand rows.

The present invention intends to provide a storage arrangement allowing a larger number of combinations and allowing storage, under the best possible conditions, of compact audio and visual cassettes and to allow their storage in a receptacle drawer whereof the dimensions are perfectly adapted to the contents.

According to a first aspect of the invention the storage arrangement is constituted by boxes of different dimensions whereby the width and the height of the second boxes for visual cassettes are respectively equal to 1.5 times the width and the height of the first boxes for audio compact cassettes and in that these boxes have, on their upper side, one pair of profiled ribs and on their lower side, the first and second boxes having respectively four and six profiled grooves with a contour interacting with the contour of the said ribs, in order to allow fitting of the said grooves in the said ribs, the distance between two adjacent grooves being equal to the distance between two adjacent ribs.

It has been found that the ratio 1,5 is especially adapted for insertion of audio and video cassettes within a rectangular arrangement.

According to another aspect of the invention, the storage arrangement comprises at least three types, namely a first large box, a second small box and at least a third box whereof the horizontal width is equal to that of one of the first or second boxes and the height is equal to the width of the other of the first or second boxes, and in that these boxes have, on their upper side, at least one pair of profiled ribs and on their lower side, at least one pair of profiled grooves with a contour interacting with the contour of the said ribs, in order to allow fitting of the said grooves in said ribs.

This arrangement allows for a space corresponding to a fourth type of box within a rectangular arrangement.

The design according to the invention allows numerous combinations in the production of a rectangular assembly in particular by overlapping. The provision of ribs and grooves makes it possible to achieve tilting of the boxes one in the other thus ensuring the cohesion of the assembly. These grooves and ribs act simultaneously as strengthening members.

The accompanying drawings show some embodiments of the invention, by way of example.

Figure 1:
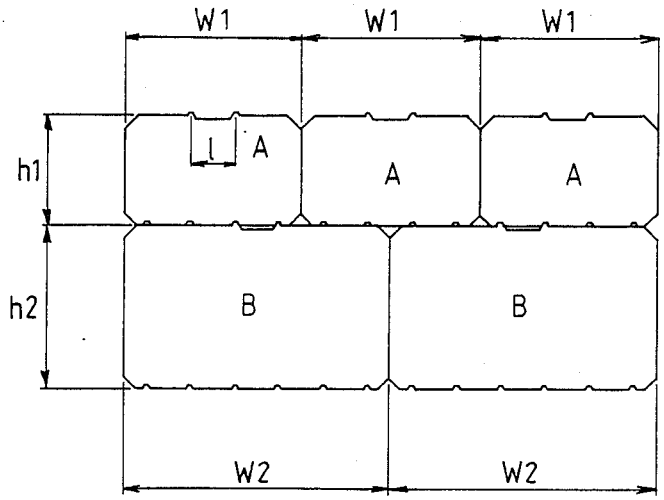
FIG. 1 is a diagrammatic front view of a first storage arrangement constituted by two types of box of different dimensions.

The storage arrangement illustrated in FIG. 1 is constituted by two types of box of different size A and B. The width w2 and the height h2 of the boxes B are respectively equal to 1,5 times the width w1 and the height h1 of the boxes A. As shown, it is thus possible to arrange a row of three small boxes A on a row of two large boxes B whilst preserving vertical alignment. In this embodiment the width and height have further a particular ratio therebetween equal to 5/3.

Figure 2:
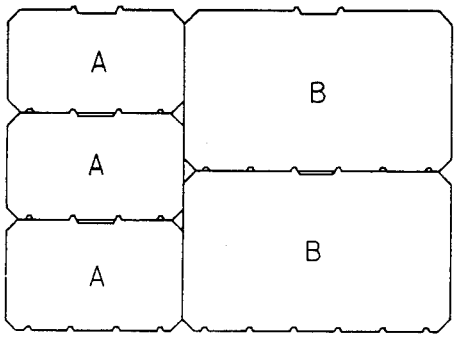
FIG. 2 is a diagrammatic view of a second storage arrangement constituted by two types of box.

FIG. 2 illustrates another possibility to obtain a rectangular arrangement with the same boxes as in FIG. 1. This arrangement is formed of a stack of three boxes of type A and a stack of two boxes of type B side by side and at the same height.

Figure 3:
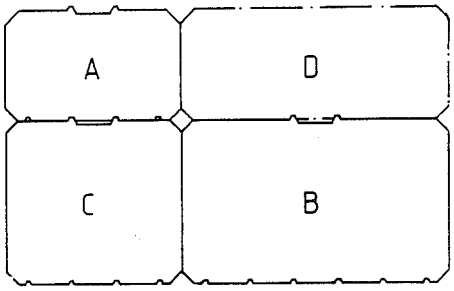
FIG. 3 is a diagrammatic view of a third storage arrangement constituted by members of FIG. 1 and/or 2 and of a third type of member.

The storage arrangement illustrated in FIG. 3 is constituted by a small box of type A, of a large box of type B and of a medium box of a third type C. The width of the box C is equal to the width of the box A, whereas its height is equal to the height of the large box B. It is thus possible to juxtapose boxes of type C vertically with boxes of type A or to juxtapose these boxes C horizontally with boxes of type B.

Figure 4:
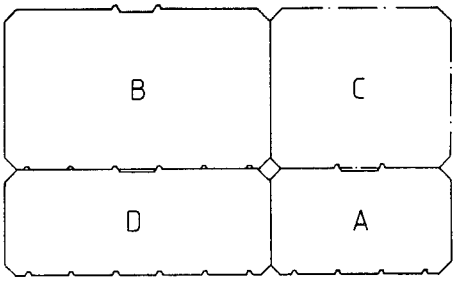
FIG. 4 is a diagrammatic view of a fourth arrangement constituted by members of FIG. 1 and/or 2 and of a third type of member.

It is also possible to provide another type of medium box. FIG. 4 shows an example of an arrangement comprising a medium box of fourth type D whereof the width is equal to the width of a large box of type B and the height is equal to the height of a small box of type A. If, as illustrated, a box of type B is placed on the box D and a box A is placed beside the box D, it will be ascertained that the space remaining above the box and to the right of the box B corresponds to a space occupied by a box of type C as shown in dot dash lines. If we refer to FIG. 3, it will also be seen that the space remaining above the box of type B corresponds to the space occupied by a box of type D. By means of the four types of boxes A, B, C and D, it is henceforth possible to produce a multitude of different combinations, i.e. of different storage arrangements.

Figure 5:
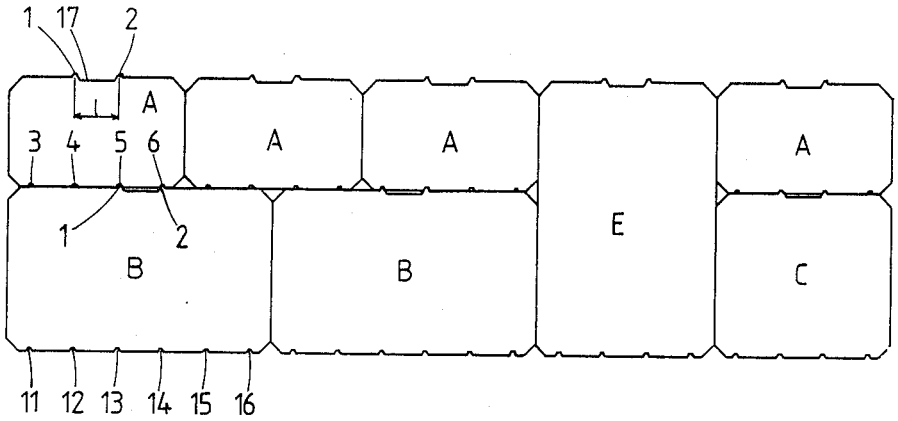
FIG. 5 is a diagrammatic view of a fifth storage arrangement constituted by four types of member.

This storage arrangement illustrated by FIG. 5 comprises two large boxes of type B arranged side by side, a row of three small boxes of type A arranged on the boxes B, a box of type E of width equal to the width of the box of type C and height equal to the width of the box of type B, arranged beside the former and two boxes stacked one on the other respectively of types A and C. A box of type B may thus be arranged horizontally, as shown or vertically thus maintaining the alignment of the members.

Figure 6:
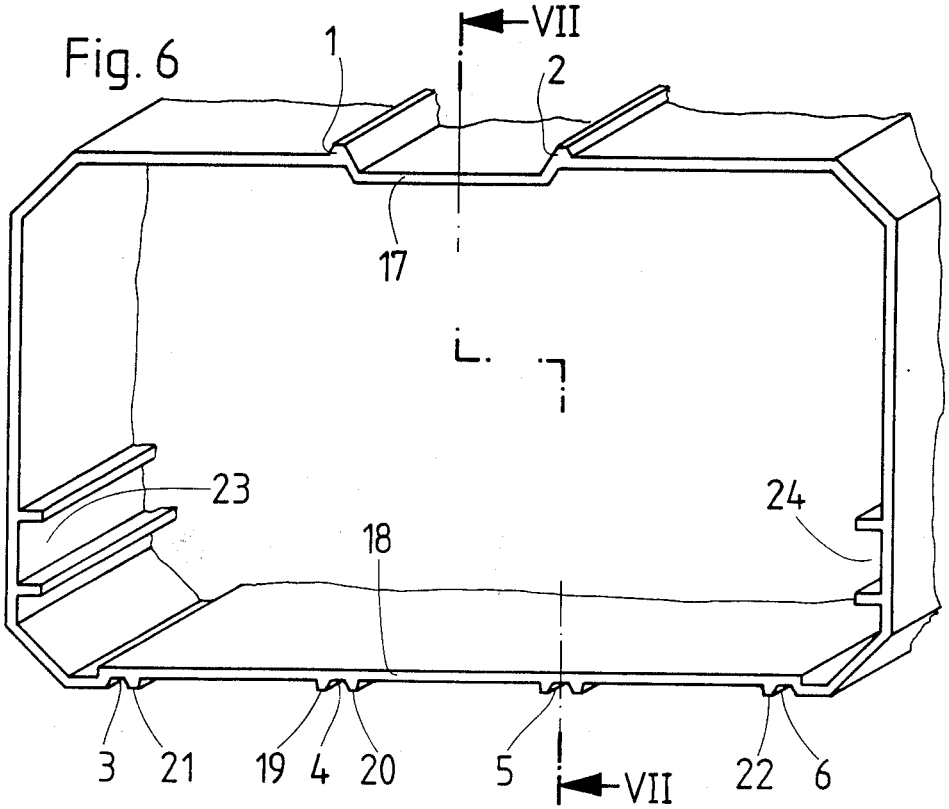
FIG. 6 shows the contour of a small box.

All the boxes have two ribs 1 and 2 of trapezoidal shape on their upper side (FIG. 6). On their lower side, boxes of type A have four equidistant grooves 3, 4, 5, and 6 of trapezoidal section matching that of the ribs 1 and 2. The ribs 1 and 2 are situated symmetrically with respect to the central plane of the box. The same is true for the grooves 4 and 5 on the one hand and 3 and 6 on the other hand. The distance 1 between the ribs 1 and 2 is equal to the distance between two adjacent grooves.

On its lower side. The box of type B comprises six equidistant grooves 11 to 16, of the same contour and of the same dimensions as the grooves 3 to 6, separated by a distance 1. The boxes of type C and E comprise lower sides identical to those of the boxes of type A. The ribs are connected by a profiled part 17 of the upper wall of the box, which profiled part ensures the rigidity of this wall (FIG. 6).

In the example illustrated in FIGS. 1 and 5, the first member of type A from the left fits on the two ribs 1 and 2 of a box of type B by two of its grooves 5 and 6. The same is true for the third box A, whereas the second box A, overlapping two boxes of type B, is held laterally by the two other boxes A. Similarly, the fourth box A (FIG. 5) is fitted on the box of type C. Only the box of type E is not fitted to another box.

FIG. 6 shows the contour of a box, in this case a box of type A, more precisely. The lower wall 18 of the box is set back slightly from the edges of the box and the central grooves 4 and 5 are each formed by two ribs 19 and 20 which ensure the rigidity of the wall. The end grooves 3 and 6 are also formed, on one side, by a strengthening rib 21, respectively 22. Two slideways 23 and 24 for a drawer are formed on the side walls of the box.

Figure 7:
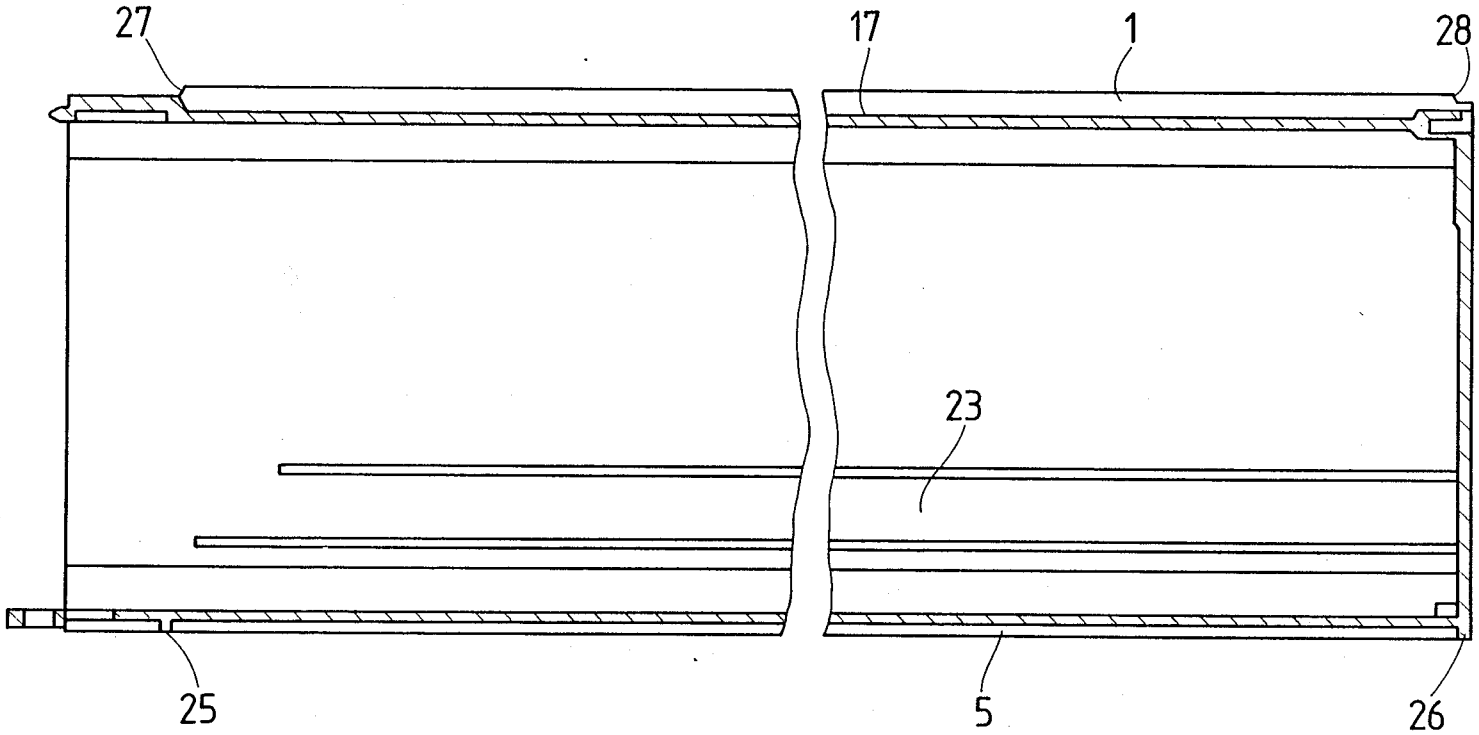
FIG. 7 is a longitudinal vertical sectional view on line VII—VII of FIG. 6.

The longitudinal section illustrated in FIG. 7 shows that the groove 5 is limited at its ends by two transverse ribs 25 and 26, whereas the groove 1 terminates obliquely in two inclined sides 27 and 28. The same is true for the other grooves and ribs. At the time of stacking, the ribs of type 1 and 2 are fitted between the transverse ribs 25 and 26, the oblique sides 27*a* and 28 ensuring positioning, cohesion and vertical alignment of the stacked boxes. The sides 27 and 28 could be vertical.

Figure 8:
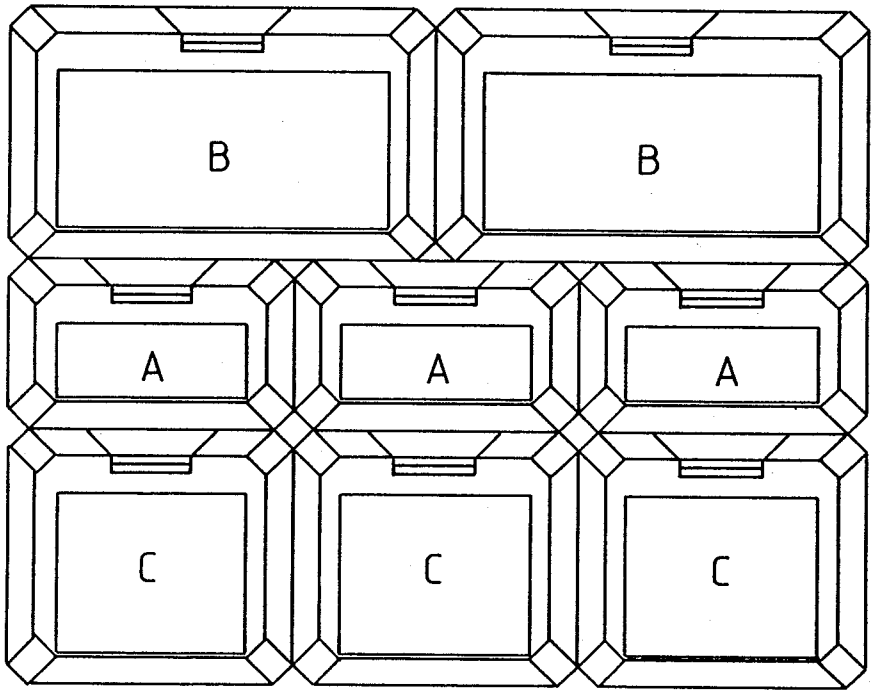
FIGS. 8 and 9 show two other combinations of box equipped with drawers, by way of example.

FIG. 8 shows another example of a combination of boxes. In this case, the boxes have been shown provided with their drawers. The arrangement is constituted by three boxes of type C supporting three boxes of type A themselves supporting two boxes of type B.

Figure 9:
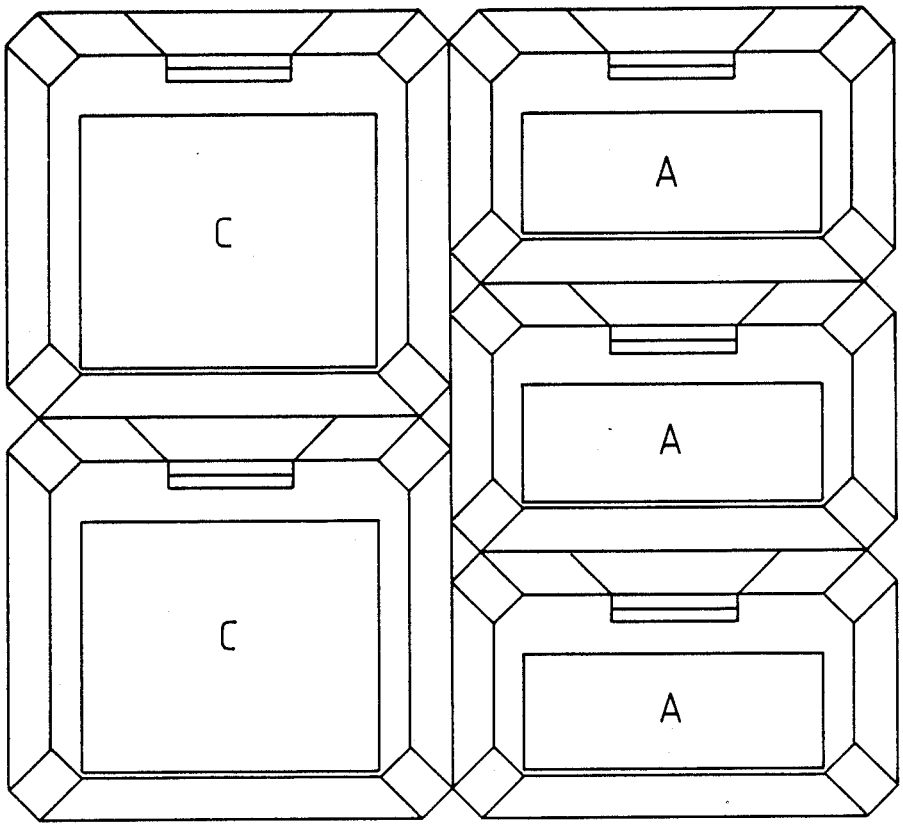

FIG. 9 shows a further example of a combination constituted by three stacked boxes of type A, beside which are placed two stacked boxes of type C. On account of the vertical modularity, the height of the two boxes of type B is equal to the height of the three stacked boxes of type C, this height being equal to 6 M2.

Figure 10:
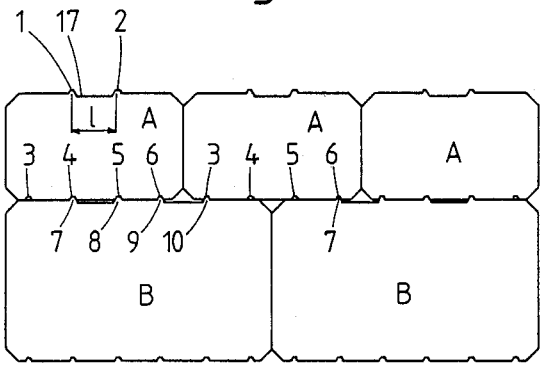
FIG. 10 shows a variation.

According to a variation illustrated in FIG. 10, the large boxes of type B have two pairs of ribs 7, 8 and 9, 10 separated by a distance 1. The ribs 1 and 7 are situated at the same distance from the edge of the box. The same is true of the ribs 2 and 10. The arrangement illustrated is similar to that illustrated in FIGS. 1 and 5, but it differs from them in that the intermediate box of type A is fitted by its grooves 3 and 6 in the rib 10 of one of the boxes of type B and in the ribs 7 of the other box of type B, thus ensuring a connection between the two boxes B.

All or part of the boxes may naturally be used for the storage of objects other than recording tapes. In particular, certain boxes may be reserved for odds and ends, tools or sewing materials.

I claim:

1. Storage arrangement for compact storing audio and visual cassettes constituted by a stack of horizontal, prismatic boxes intended to contain drawers, characterized by first and second boxes of two different dimensions, whereby the width and the height of the second boxes for visual cassettes are respectfully equal to 1.5 times the width and the height of the first boxes for audio compact cassettes and in that these boxes have, on their upper side, one pair of profiled ribs and a first type of groove and on their lower side, the first and second boxes having respectively four and six profiled grooves of a second type with a contour interacting with the contour of the said ribs, in order to allow fitting of the said grooves in the said ribs, the distance between two adjacent groovers being equal of the distance between two adjacent ribs, said first type of groove being limited at its end by two transverse ribs and said second type of grooves terminating obliquely in two inclined sides so that said ribs are self positioned in the grooves of another box and the superposed boxes are blocked together longitudinally.

2. Storage arrangement for storing audio and visual cassettes constituted by a stack of horizontal, prismatic boxes intended to contain drawers, characterized in that said arrangement comprises at least three types of box, namely a first large box, a second small box and at least a third box whereof the horizontal width is equal to that of one of the first or second boxes and the height is equal to the width of the first or second boxes, and in that these boxes have, on their upper side, at least one pair of profiled ribs and a first type of groove and on their lower side, at least one pair of profiled grooves of a second type with a contour interacting with the contour of the said ribs, in order to allow fitting of the said grooves in said ribs, said first type of groove being limited at its end by two transverse ribs and said second type of grooves terminating obliquely in two inclined sides so that said ribs are self positioned in the grooves of another box and the superposed boxes are blocked together longitudinally.

3. Storage arrangement according to claim 2, comprising four types of box, wherein the horizontal width of the third type of box is equal to the horizontal width of said small box and its height is equal to the height of said large box and the horizontal width of the fourth type of box is equal to the width of said large box and its height is equal to the width of said small box and wherein the boxes of all types have on their upper side a pair of profiled ribs and on their lower side, the small box four profiled grooves, the large box six profiled grooves and the third type of box four profiled grooves and the fourth type of box six profiled grooves, said profiled grooves interacting with the contour of the said ribs, in order to allow fitting of the said grooves in the said ribs, the distance between two adjacent grooves being equal to the distance between two adjacent ribs.

4. Arrangement according to claim 1 wherein the grooves are formed by strengthening ribs.

5. Arrangement according to claim 1 wherein a strengthening profile is provided between each pair of ribs.

6. Storage arrangement according to claim 1, wherein the ratio between the width and the height of the boxes is equal to 5/3.

7. A storage arrangement according to claim 1 wherein said groove and said ribs are arranged to interfit horizontally.

8. A storage arrangement to claim 1 wherein said grooves are formed separate from said ribs.

9. A storage arrangement according to claim 8 wherein said grooves and said ribs are located on opposing surfaces of said boxes.

10. A storage arrangement according to claim 1 further comprising two large boxes and one small box, each said two large boxes being interfitted by said ribs and said grooves to said small box so as to connect said two large boxes together.

* * * * *